US005419638A

United States Patent [19]

Jamison

[11] Patent Number: 5,419,638

[45] Date of Patent: May 30, 1995

[54] PRESSURE SENSITIVE GAS VALVE FOR FLEXIBLE POUCH

[76] Inventor: Mark D. Jamison, 3333 Sharon Pl., Zion, Ill. 60099

[21] Appl. No.: 57,540

[22] Filed: May 6, 1993

[51] Int. Cl.[6] ..... B65D 33/01

[52] U.S. Cl. ..... 383/100; 383/107

[58] Field of Search ..... 383/100, 103, 107

[56] References Cited

U.S. PATENT DOCUMENTS

| | | | |
|---|---|---|---|
| Re. 32,018 | 11/1985 | Domke et al. . | |
| 2,361,344 | 10/1944 | Yates | 383/100 X |
| 2,595,708 | 5/1952 | Salfisberg | 383/100 X |
| 2,633,284 | 3/1953 | Moffett et al. | 383/100 X |
| 3,311,287 | 3/1967 | Long et al. | 383/100 |
| 4,122,993 | 10/1978 | Glas . | |
| 4,394,955 | 7/1983 | Raines et al. . | |
| 4,491,245 | 1/1985 | Jamison . | |
| 4,620,247 | 10/1986 | Papciak et al. . | |
| 4,653,661 | 3/1987 | Buchner et al. . | |
| 4,656,068 | 4/1987 | Raines . | |
| 4,690,667 | 9/1987 | Domke . | |
| 4,793,121 | 12/1988 | Jamison . | |
| 4,800,708 | 1/1989 | Sperry | 383/100 X |
| 4,879,430 | 11/1989 | Hoffman . | |
| 4,935,283 | 6/1990 | Jamison . | |
| 4,971,218 | 11/1990 | Buchner et al. . | |
| 5,018,646 | 5/1991 | Billman et al. . | |
| 5,059,036 | 10/1991 | Richison et al. . | |
| 5,139,804 | 8/1992 | Hoffman . | |

FOREIGN PATENT DOCUMENTS

| | | | |
|---|---|---|---|
| 0248949 | 8/1966 | Austria | 383/100 |
| 1367922 | 6/1964 | France | 383/100 |
| 0139352 | 5/1990 | Japan | 383/100 |
| WO8802339 | 4/1988 | WIPO . | |

OTHER PUBLICATIONS

Plitek—Plitek Pressure Relief Valve Jul. 8, 1991—Illinois, U.S.A.

*Primary Examiner*—Allan N. Shoap
*Assistant Examiner*—Jes F. Pascua
*Attorney, Agent, or Firm*—Ladas & Parry

[57] ABSTRACT

A flexible pouch having a pressure sensitive gas valve for releasing gas from a sealed flexible pouch is disclosed. The gas valve is integrally formed in the lateral edge portions of the front and back wall panels which are heat sealed to form the flexible pouch. The gas valve has an unobstructed tortuous gas pathway, preferably having convoluted channels, extending across at least one and preferably both of the lateral heat seals of the pouch with one end of the gas pathway opening into the interior of the flexible pouch and the outer end of the gas pathway open to the ambient atmosphere at the outer edge of the lateral heat seal. A method of forming a pressure sensitive gas valve in each lateral heat seal of a flexible pouch is also disclosed.

18 Claims, 2 Drawing Sheets

Fig. 1
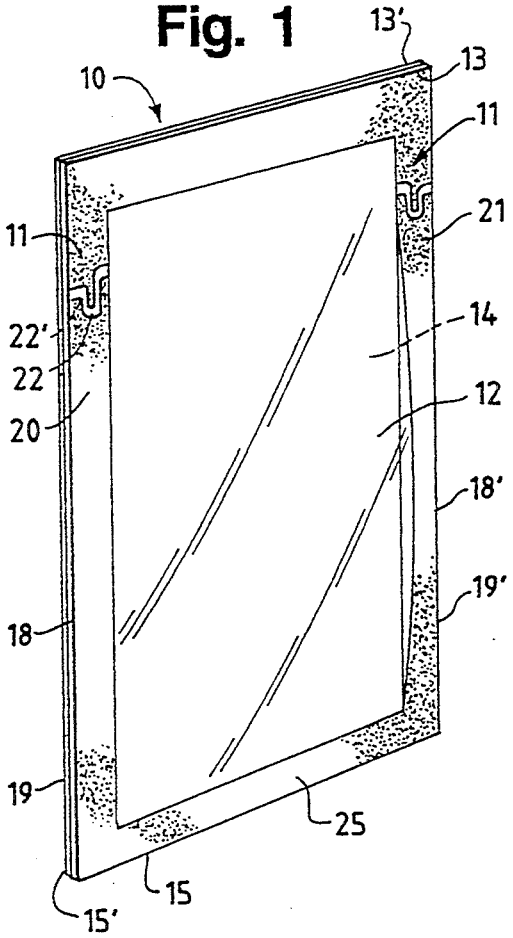
Fig. 2
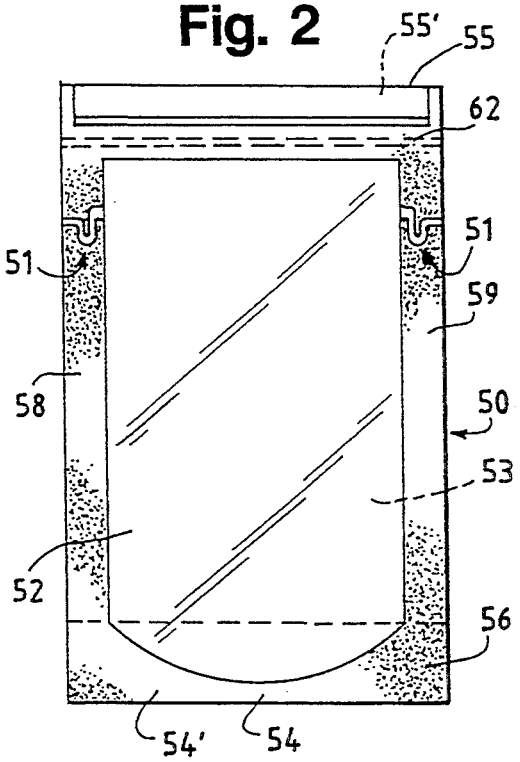
Fig. 3A
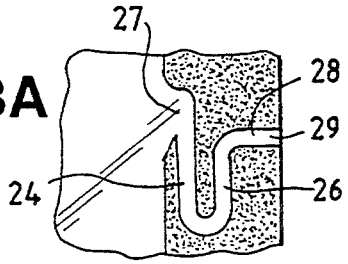
Fig. 3D
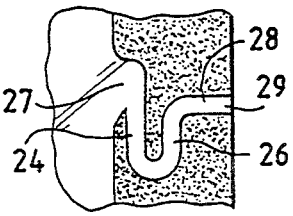
Fig. 3
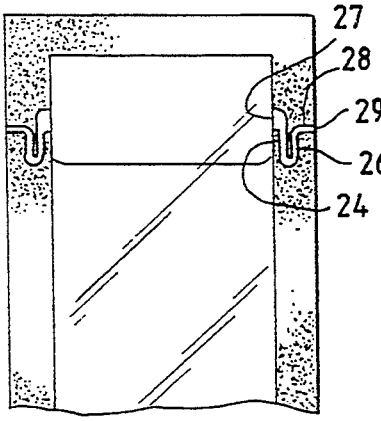
Fig. 3B
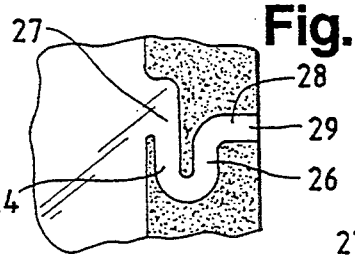
Fig. 3E
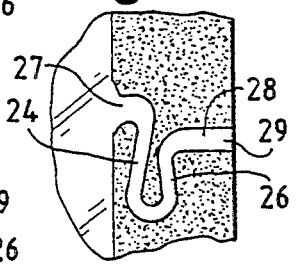
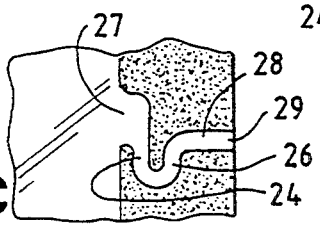
Fig. 3C

PRESSURE SENSITIVE GAS VALVE FOR FLEXIBLE POUCH

BACKGROUND OF THE INVENTION

In the packaging of certain products, such as freshly roasted coffee beans, in a sealed flexible container or pouch a significant amount of gas is released from the product which creates considerable pressure within the pouch and which is capable of rupturing the pouch. Consumers are reluctant to purchase or use a product within a bloated container, so it is important to avoid gas build up within a flexible container. Thus, it is important to provide a flexible container which provides for the release of gases from products packaged in a sealed flexible container or pouch. Moreover, many products packaged in flexible containers are damaged by oxygen entering the flexible container and the means which allows gas to escape from a sealed flexible pouch must also prevent air from entering the sealed container.

Many flexible container or pouch structures have been devised having a self-sealing gas valve which allows gas within a sealed flexible pouch to escape before the internal gas pressure causes the pouch to have a bloated appearance which causes the pouch to rupture. One such recent U.S. patent typical of the prior art sealed flexible pouch structures having a pressure sensitive gas valve is U.S. Pat. No. 5,059,036 issued to Richison et al. The Richison et al structure and all other know relevant prior art structures have self-sealing pressure sensitive gas relief valves which are mounted on a wall of the container as an adjunct to the container, usually after the container has been formed, in a time consuming operation which increases the cost of the pouch significantly due to increased labor and material costs.

SUMMARY OF THE INVENTION

A pressure sensitive gas relief valve is provided by providing in a lateral edge portions of the front and back wall panels of a flexible container or pouch, preferably at a point spaced a short distance below the upper seal of the pouch, a tortuous gas pathway extending across at least one of the lateral heat seals of the pouch with the inner end of the gas pathway opening into the interior of the flexible container and the outer end of the gas pathway open to the atmosphere at the outer edge of the lateral heat seal. When the gas pressure within the sealed flexible pouch does not exceed the ambient atmospheric pressure, the tortuous gas pathway collapses at one or more points along the length thereof to prevent air from entering the pouch, but when the gas pressure within the pouch exceeds a predetermined value the tortuous gas pathway will open to allow gas to escape from the pouch.

When a gas flow pathway or channel is formed between films of heat sealable polymeric material, any change in direction of the flow pathway from linear flow and the mere heat sealing of the film causes Stress points within the channels creating a tendency for contiguous thin polymeric films to adhere to each other and causes the pathway to collapse from front to back and close the channels to the flow of gas through the gas pathway when there is no gas pressure from within the pouch. Also, because polymeric film material has a memory and tends to return to its original planar state, any pathway formed in the said film, as by impressing a tortuous pathway in the surface of the film, will tend to flatten out and collapse in the absence of pressure from within the flexible pouch or container. And, when the films forming the tortuous gas pathway adhere to each other, the pathway formed in the lateral heat seal closes and acts as a one-way valve so that air is not able to enter the pouch and damage material within the pouch.

In a gas pressure relief valve for a flexible film pouch, it is of critical importance to insure that the gas valve pathway does not remain closed when the gas pressure within the pouch reaches a predetermined pressure to avoid rupturing the pouch or allowing the sealed pouch to become bloated. Thus, in order to provide an effective gas relief valve having contiguous films of polymeric material, it has been found necessary to counteract to a controlled degree the several characteristics of superimposed thin films of polymeric material to adhere to each other and close a narrow tortuous gas pathway formed therebetween. One of the methods of controlling the normal tendency of the superimposed films of polymeric material to stick together which can be used to provide the herein disclosed novel gas relief valve is controlled stretching of the films in the area which must not remain closed (i.e. the area forming the tortuous gas pathway).

A further control over the pressure required to open a tortuous gas pathway to allow gas to flow outwardly from a sealed flexible pouch is effected by controlling the dimensions of the tortuous gas pathway, including but not limited to the configuration of the tortuous gas pathway, the length of the gas pathway and the presence or absence of parallel sections in the gas pathway. It has also been found that when the gas pathway formed in the lateral heat seal has two convoluted channel sections which are parallel and preferably parallel to a lateral edge of the pouch, these parallel convoluted channels open more readily under gas pressure from within the pouch. It has also been found that having the length of the inner depending parallel convoluted channel slightly longer than the length of the upwardly extending outer convoluted channel with the opening of the gas pathway into the flexible pouch slightly higher or approximately opposite the gas pathway outlet having a direct positive influence on the ability of the channel to open readily. FIGS. 3*a*–3*e* show different tortuous gas pathways which are suitable for forming a gas valve in a flexible pouch but responds to a slightly different gas pressure from within a flexible container. In general, the smaller the diameter and the longer the tortuous gas pathway, the greater the gas pressure within the pouch required to open the pathway. In the absence of gas pressure within the sealed flexible container the several gas pathway disclosed remains closed.

While the configuration of the tortuous gas pathway can be varied considerably, it has been found that pressure sensitive gas valves which respond readily to pressure within a flexible pouch have tortuous gas pathways which comprise two parallel convoluted channels. Varying the lengths of the convoluted channels changes the properties of the gas valve, and in a preferred embodiment the inner depending convoluted channel is lightly longer than the outer convoluted channel. By combining and controlling the above mentioned variables in the design of the tortuous gas pathway, it is possible to design a gas valve having the convoluted channels which are best suited for storing a particular material within a sealed flexible container. For example, where a flexible container or pouch is to contain a product which gives off a large volume of gas during storage, such as freshly roasted coffee beans, the configuration of the tortuous gas pathway will be different from the configuration of the gas pathway in a container for packaging dried beans.

The invention disclosed herein also comprises a novel method of providing a pressure sensitive gas valve having a tortuous gas pathway formed between superimposed thin polymeric films of heat sealable material with the tortuous gas pathway extending across at least one of the lateral heat seals and preferably across both lateral heat seals of a flexible pouch or container. After selecting a tortuous gas pathway having a design suitable for use in a flexible pouch in which a selected product is to be packaged, an insert for a pre-forming die is constructed having the selected tortuous gas pathway formed as a depressed area therein. A web of thin polymeric film which will form the front wall panel of the flexible pouch and a second like web which will form the back wall panel of the flexible pouch are positioned between a said pre-forming die having formed therein the selected tortuous gas pathway. The film webs are positioned between the dies so that lateral edge portions of the webs are disposed opposite the selected tortuous gas pathway formed in the pre-forming dies. Pressure is applied to the webs in the dies and the film webs are stretched sufficiently to force the webs into the depressed areas of the dies so that the gas pathway areas have a reduced tendency to adhere.

The two film webs which have a selected lateral edge portion thereof stretched are moved sequentially through a first heat sealing station (and thereafter optionally to a second heat sealing station) where the webs are precisely positioned between dies having formed in the walls thereof grooves in the form if mirror image pathways identical in shape and dimensions to the tortuous gas pathways which has been stretched into the lateral edge portions of the film webs. When the heat sealing dies are closed on the film webs in the heat sealing station to join the front and rear side panels along the lateral edges of the panels with the tortuous gas pathway stretched into the webs in registry with the tortuous gas pathway in the heat sealing dies, the tortuous gas pathways formed in the lateral heat seals are not crushed or otherwise damaged. As an optional step the heat sealed film webs can be further heat treated in a second heat sealing station having dies like the first heat sealing dies to finalize the several heat seals. The heat sealed webs are then cooled, trimmed and the pouches having an integral pressure sensitive gas valve formed in the lateral heat seal thereof are prepared for shipping or filling.

BRIEF DESCRIPTION OF THE DRAWINGS

FIG. 1 is a perspective view of a flexible pouch having a pressure sensitive gas valve in the lateral heat seals thereof according to the present invention, FIG. 2 is a front elevational view of a stand-up flexible container in a folded position having a pressure sensitive gas valve according to the present invention, FIG. 3, FIG. 3*a*, FIG. 3*b*, FIG. 3*c*, FIG. 3*d* and FIG. 3*e* are schematic views of several tortuous gas pathways useful in forming a pressure sensitive gas valve of the present invention.

DETAILED DESCRIPTION OF THE INVENTION

Figure 5:
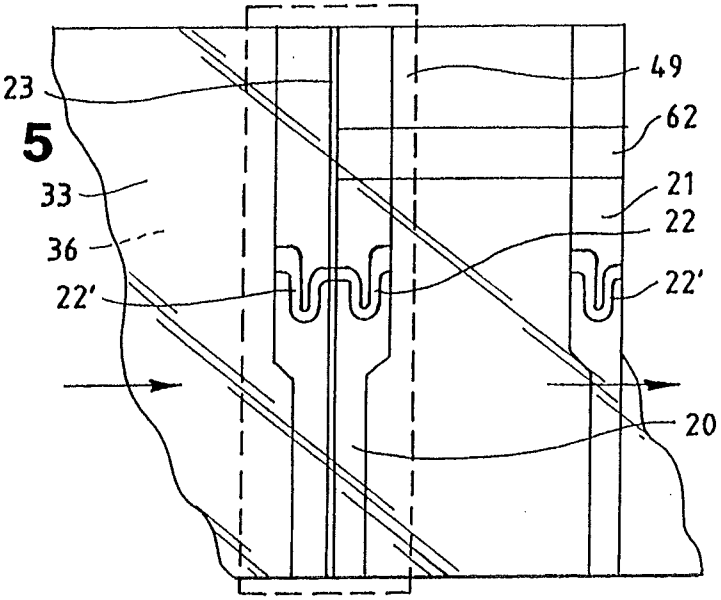
FIG. 5 is a schematic representation of pre-formed film webs having mirror image tortuous gas pathways impressed therein in registry with like mirror image gas pathways formed in heat sealing dies formed along a film web split line corresponding to a lateral edge of a pouch.

In FIG. 1 a flexible container or pouch 10 is shown having pressure sensitive gas valves 11 of the present invention formed integrally therewith. The pouch 10 is formed of generally rectangular front wall and rear wall panels 12, 14, respectively, of thin heat sealable polymeric material. The panels 12, 14 have upper ends 13, 13' and lower ends 15, 15', respectively. The lateral edges 18, 18' of the panel 12 and the lateral edges 19, 19' of the panel 14, are joined by heat seals to form lateral heat seals 20, 21 of the pouch 10. The lower ends of the panels 12, 14 are joined by heat seal 25, with upper ends of the panels 12, 14 only partially heat sealed to allow for filling of the pouch 10 with the product.

The pressure sensitive valve 11 is formed integrally with the pouch 10 by providing on facing surface areas of each lateral edge portion of the front wall panel 12 and the back wall panel 14 mirror image tortuous gas pathways 22, 22', as by treating or stretching the surface areas to impress thereon the configuration of the gas pathways 22, 22'. Thereafter the facing lateral edge portions of the panels 12, 14 are joined by heat sealing all areas thereof except in the stretched areas having the form of the tortuous gas pathway.

While a certain level of adherence of the film webs is desirable so that the gas pathway remains closed when there is no excess gas pressure within the pouch 10, in order to provide a pressure sensitive gas valve 11 which responds readily to the pressure inside a sealed flexible container or pouch 10 and opens before the internal gas pressure ruptures the pouch 10 or causes the pouch 10 to become bloated, it is necessary to treat the contiguous surface areas of the front wall panel 12 and the rear wall panel 14 where a tortuous gas pathway is defined to overcome the tendency of contiguous surfaces of thin polymeric film to adhere to each other. Any treatment to reduce the tendency of thin polymeric film to adhere to each other can be used. Preferably, the surfaces of the panels 12, 14, in which a tortuous gas pathway is formed are subjected to stretching in a preforming treatment which heretofor has been shown to reduce the tendency of contiguous thin polymeric film to adhere to each other.

Figure 4:
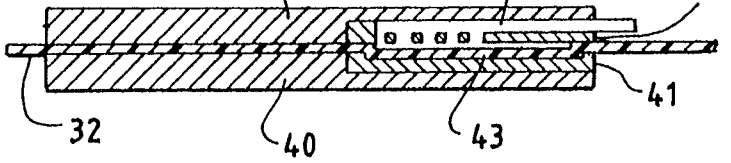
FIG. 4 is a vertical sectional view of tortuous gas pathway pre-forming dies.

A conventional method of pre-forming by stretching of a single film web is shown in FIG. 4. The film web 32 is positioned above a pre-forming die plate 40 which comprises a pre-forming die insert 41 having grooves 43 formed therein with the configuration of the desired tortuous gas pathway. The film web 32 is positioned in the die insert 41 so that the gas pathway formed in the insert 41 will engage the web 32 in an area which will form a lateral edge portion of the pouch. Co-acting with the die plate 40 is an air pressure die plate 45 which has an insert 46 and a gas chamber 47 for receiving pressurized gas, such as air. The insert 46 has passages facing the grooves 43 in the die insert 41. When the cold die plates 40 and 45 are closed on the section of film web 32, air at a pressure of between 80–100 psi is introduced into the chamber 47, and the film web of metalized polymeric material, such as poly-ester film having a film thickness of about 0.004–005 mills is forced into the grooves 43 of the cold forming dies causing the configuration of the tortuous gas pathway to be impressed into the surface of the film web 32.

Figure 6:
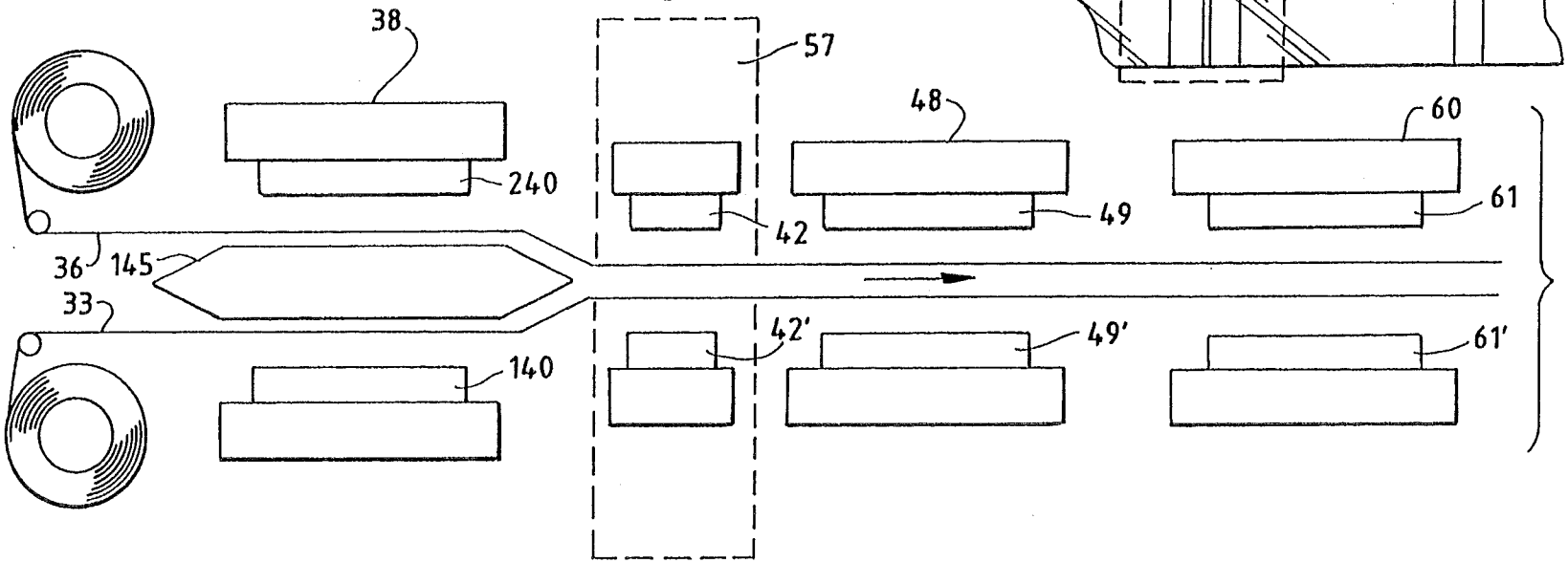
FIG. 6 is a schematic diagram of the operational steps used in forming a flexible pouch having a pressure sensitive gas valve according to the present invention.

A similar pre-forming method is shown in FIG. 6 wherein a pair of film webs 33, 36 are positioned at a pre-forming station 38. Film web 33 is positioned above a pre-forming die plate 140 which corresponds to the die plate 40 of FIG. 4. An air pressure die plate 145 is positioned above the film web 33 and corresponds to the die plate 45 of FIG. 4. The film web 36 is similarly positioned adjacent a pre-forming die plate 240 and the common air pressure die plate 145 which is a modified version of the die plate 45 so as to provide simultaneous pre-forming of both film webs 33, 36.

With the configuration of the tortuous gas pathway impressed or stretched into the surfaces of the film webs 33, 36, the film webs 33, 36, are next positioned at heat sealing station 48 between heat sealing die plates 49, 49', to form the lateral heat seals 20, 21, of the pouch 10. The die plates 49, 49', each have mirror image depressed areas therein corresponding to the tortuous gas pathway 22, 22', formed along a line therein which will form when the webs 33, 36 are cut a lateral edges of a pouch 10. The film webs 33, 36 are positioned between die plates 49, 49', with the impressed tortuous gas pathways 22, 22', in registry with the mirror image depressed areas in the die plates 49, 49', so that when the die plates 49, 49', are closed upon the film webs 33, 36, with a die pressure of about 80 psi and a temperature of about 280 degrees F. for 1.2 seconds, the lateral edge portions of the pouch 10 are sealably joined except in the area impressed with the configuration of the tortuous gas pathway, forming lateral heat seals 20, 21, with an unobstructed tortuous gas pathway extending across at least one of said lateral heat seals 20, 21, so that the inner end of said pathway opens into the interior of the flexible pouch and the outer end of the pathway is open to the ambient atmosphere at the outer edge of a lateral heat seal when the film webs are cut.

FIG. 5 represents schematically the film webs 33, 36, after having the tortuous gas pathways 22, 22', impressed therein at the pre-forming stations 38, with the film web positioned in the heat sealing dies 49, 49', in superimposed registry with mirror image gas pathways like pathways 22, 22', formed in the die insert 46. The film webs 33, 36, are labeled to designate the relationship of adjoining pouches in the film webs and to identify the several parts of the pouches before the webs are cut to form individual pouches. It should be evident that the upper gas pathway 22 of the interconnected mirror image gas pathways is formed adjacent the trailing edge of the leading pouch while the lower gas pathway 22' of the mirror image gas pathways is formed adjacent the leading edge of the trailing pouch and that the gas pathways 22, 22' are interconnected at the lateral edge common to the leading and trailing pouches. The gas pathways 22, 22' are open to the ambient atmosphere only when the film webs 33, 36, are cut to form individual pouches along the split line 23 formed by the lateral edge common to the leading and trailing pouches in the film webs. By providing contiguous mirror image gas pathways in the film webs 33, 36, with gas pathway 22 and gas pathway 22' on opposite sides of each pouch lateral edge along which the film webs are split to form individual pouches, a pressure sensitive gas valve is formed in each lateral heat seal of the flexible pouch 10 when the film web is cut to form individual pouches.

After all the required heat seals have been formed in one or more heat sealing operations the pouch is transferred to a cooling die station 60 where the heat seals are cooled in cold die plates 61, 61', having structure similar in structure to die plates 49, 49', but maintained at cool tap water temperature until the heat seals are sufficiently cooled to avoid distortion of the seals. Thereafter, the film webs are cut, trimmed and the pouches are made ready for shipping or filling with the product.

In a preferred embodiment of gas valve 11 adapted for use in a flexible pouch for packaging freshly roasted coffee beans the tortuous gas pathway is formed of two parallel convoluted channels 24, 26, with the inner convoluted channel 24 having an enlarged lateral opening 27 extending into the interior of pouch 10 and the outer slightly shorter upwardly extending convoluted channel 26 having a laterally extending outlet channel 28 which extends to the outer edge of the lateral heat seal. The lateral openings 27 of the convoluted channel 24 and the outer end 29 of the convoluted channels 26, are only slightly displaced with the inner opening 27 slightly higher than the outer open end 29 of the channel 28. The foregoing tortuous gas pathway has convoluted channels formed from metalized polyester film having a thickness of between 0.0015 to 0.008 mills with an average thickness of 0.004 and 0.005 mills. The convoluted channels forming the tortuous gas pathway may have an interior diameter of about 0.03 to 0.375 inches depending on the size of the pouch and the length of the tortuous gas pathway. As noted previously, the gas valve 51 will open when the gas pressure within the preferred pouch 10 reaches a predetermined value ranging between about 0.006 to 0.11 psi.

In FIG. 2 of the drawing a pressure sensitive gas valve 51 embodying the present invention is provided in the lateral heat seals of a stand-up type flexible container or pouch 50 of known construction. The stand-up flexible pouch is shown in FIG. 2 in folded position and is formed with opposed front wall section 52 and back wall section 53 each with lower end edges 54, 54°, and upper end edges 55, 55'. A foldable base section 56 is provided to facilitate the pouch 50 standing upright. Also, the pouch 50 is provided with a Ziploc (R) type closure strip 62 in the front wall panel 52 spaced below the upper heat seal to permit opening and closing the pouch for removal of some of the contents without breaking any of the heat seals of the pouch.

The pressure sensitive gas valve 51 is incorporated into the lateral heat seals 58, 59 of the pouch 50 at a point slightly below the level of the closure strip 62, in the same manner as described in connection with the pouch 10. As in the pre-forming treatment to which webs 33, 36, are subjected, selected portions of the heat sealable thin polymeric film webs which form the lateral wall sections 52, 53, are subjected to a pre-forming treatment in which the webs are stressed to effect a stretching of the film out of its normal planar state to impress in the surface thereof the tortuous gas pathway and reduce the tendency of the film webs to adhere to each other. And, before transferring the web sections to the heat sealing dies, the foldable base section 56 is heat sealed to the front and back wall sections 52, 53, at a gusset spot welding station 57 using spot welding dies 42, 42'. The film webs from which the front and back wall sections are formed with the base section 56 heat sealed to the film webs are positioned between heat sealing dies having depressed areas with mirror image tortuous gas pathways formed therein, as in die plates 49, 49'. The portions of the webs from which the wall sections 52, 53, are formed and positioned in the heat sealing dies with the stretched film web area having the configuration Of the gas pathway impressed therein in registry with the dies having mirror image depressed areas in the form of a tortuous gas pathway, and the dies closed to heat seal the lateral edge portions of the webs to form the lateral edges of the flexible stand-up pouch having an unobstructed tortuous gas pathway formed therein extending across at least on one of the lateral heat seals 58, 59, of the flexible pouch 50, in the same manner as described in connection with the fabrication of pouch 10.

Various thin heat sealable polymeric films can be used in the constructions of a flexible pouch embodying the pressure sensitive gas valve of the present invention including but not limited to metalized and non-metalized polyester, polyolefin, polyester/polyolefin laminates, nylon and laminated foil polymeric film material. Many converters of co-polymer film structures are suppliers of the preferred thin metalized polyester film for fabricating the pressure sensitive gas valve of the present invention, such as Clear-Lam Packaging Company, Elk Grove Village, Ill.

I claim:

1. In a sealed flexible pouch of the type having a pressure sensitive gas valve for releasing gas pressure from the interior of the sealed flexible pouch, in which the pouch is formed of a back wall panel of heat sealable polymeric material, and a front wall panel of heat sealable polymeric material, said front wall panel being superimposed on said back wall panel, and lateral edge portions of said front and back wall panels joined by a heat seal in all areas thereof in facing registered relationship forming a lateral heat seal of said pouch, the improvement which comprises:

the gas valve being formed integral with the pouch by forming a tortuous gas pathway extending across said lateral edge portion of the back wall panel, and by forming a tortuous gas pathway extending across said lateral edge portion of the front wall panel, said tortuous gas pathways disposed in facing registered relationship, in which the lateral edge portions of the front and back wall panels are not Joined by the lateral heat seal in the area of said tortuous gas pathways, said tortuous gas pathway having an inner end thereof opening into the interior of said flexible pouch at an inner edge of said lateral heat seal and an outer end of said tortuous gas pathway open to the ambient atmosphere at an outer edge of said lateral heat seal, and said tortuous gas pathways being impressed in said film webs across an area of the lateral edge portion which has a varying cross section.

2. A flexible pouch having a gas valve as in claim 1, wherein said tortuous pathway is formed with a plurality of parallel convoluted channels.

3. A flexible pouch having a gas valve as in claim 2, wherein said convoluted channels extend generally parallel to a lateral heat seal of said pouch.

4. A flexible pouch having a gas valve as in claim 2, wherein the convoluted channel which is innermost of the plurality of channels extends downwardly parallel to one of said lateral edge portions of said pouch and has a greater length than the convoluted channel which is outermost of the plurality of channels, the outermost channel coupled to the innermost channel and extending upwardly.

5. A flexible pouch having a gas valve as in claim 2, wherein the convoluted channel which is innermost of the plurality of channels has at an upper end a short transverse opening extending into the interior of said pouch and the convoluted channel which is outermost of the plurality of channels has extending laterally from the upper end a transverse channel terminating at the outer edge of said lateral heat seal.

6. A flexible pouch having a gas valve as in claim 1, wherein the inner end of said tortuous gas pathway lies in a transverse plane above the outer end of said tortuous gas pathway.

7. A flexible pouch having a gas valve as in claim 20, wherein said heat sealable polymeric material has a film thickness of from about 0.0015 to 0.008 mills.

8. A flexible pouch having a gas valve as in claim 1, wherein said tortuous gas pathway has an internal diameter of about 0.03 to 0.375 inches.

9. A flexible pouch having a gas valve as in claim 1, wherein each said lateral heat seal of said pouch has an unobstructed tortuous gas pathway extending across the width thereof.

10. In a sealed flexible pouch of the type having a pressure sensitive gas valve for releasing gas pressure from the interior of the sealed flexible pouch, in which the pouch is formed of a back wall panel of heat sealable polymeric material, and a front wall panel of heat sealable polymeric material, said front wall panel being superimposed on said back wall panel, and lateral edge portions of said front and back wall panels joined by a heat seal in all areas thereof in facing registered relationship forming a lateral heat seal of said pouch, the improvement which comprises:

the gas valve being formed integral with the pouch by forming a tortuous gas pathway extending across said lateral edge portion of the back wall panel, and by forming a tortuous gas pathway extending across said lateral edge portion of the front wall panel, said tortuous gas pathways disposed in facing registered relationship, in which the lateral edge portions of the front and back wall panels are not Joined by the lateral heat seal in the area of said tortuous gas pathways, said tortuous gas pathway having an inner end thereof opening into the interior of said flexible pouch at an inner edge of said lateral heat seal and an outer end of said tortuous gas pathway open to the ambient atmosphere at an outer edge of said lateral heat seal, and the front and back wall panels of said pouch having impressed in the surface thereof the tortuous gas pathway, the panels having a varying cross-section in an area of the tortuous gas pathways, the pathways extending generally parallel to a lateral edge of the lateral heat seal of the pouch with laterally extending pathways at the upper end thereof in approximately the same transverse plane, whereby said gas valve opens for the outflow of gas from said pouch when the gas pressure within said pouch reaches a predetermined value.

11. A flexible pouch having a gas valve as in claim 10, wherein said tortuous pathway is formed with a plurality of parallel convoluted channels.

12. A flexible pouch having a gas valve as in claim 11, wherein said convoluted channels extend generally parallel to a lateral heat seal of said pouch.

13. A flexible pouch having a gas valve as in claim 11, wherein the convoluted channel which is innermost of the plurality of channels extends downwardly parallel to one of said lateral edge portions of said pouch and has a greater length than the convoluted channel which is outermost of the plurality of channels, the outermost channel coupled to the innermost channel and extending upwardly.

14. A flexible pouch having a gas valve as in claim 11, wherein the convoluted channel which is innermost of the plurality of channels has at an upper end a short transverse opening extending into the interior of said pouch and the convoluted channel which is outermost of the plurality of channels has extending laterally from the upper end a transverse channel terminating at the outer edge of said lateral heat seal.

15. A flexible pouch having a gas valve as in claim 10, wherein the inner end of said tortuous gas pathway lies in a transverse plane above the outer end of said tortuous gas pathway.

16. A flexible pouch having a gas valve as in claim 10, wherein said heat sealable polymeric material has a film thickness of from about 0.0015 to 0.008 mills.

17. A flexible pouch having a gas valve as in claim 10, wherein said tortuous gas pathway has an internal diameter of about 0.03 to 0.375 inches.

18. A flexible pouch having a gas valve as in claim 10, wherein each said lateral heat seal of said pouch has an unobstructed tortuous gas pathway extending across the width thereof.

* * * * *

UNITED STATES PATENT AND TRADEMARK OFFICE

CERTIFICATE OF CORRECTION

PATENT NO. : 5,419,638

DATED : May 30, 1995

INVENTOR(S) : Mark D. Jamison

It is certified that error appears in the above—identified patent and that said Letters Patent is hereby corrected as shown below:

Column 8, line 16, change "20" to --1--.

Signed and Sealed this

Fifth Day of September, 1995

*Attest:*

*Attesting Officer*

BRUCE LEHMAN

*Commissioner of Patents and Trademarks*